US007970319B2

(12) United States Patent
Kawano et al.

(10) Patent No.: US 7,970,319 B2
(45) Date of Patent: Jun. 28, 2011

(54) CHARGING APPARATUS, PRINT ENGINE THAT INCORPORATES THE CHARGING APPARATUS, AND IMAGE FORMING APPARATUS THAT INCORPORATES THE PRINT ENGINE

(75) Inventors: Masahiro Kawano, Tokyo (JP); Yukiyoshi Oda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/453,860

(22) Filed: May 26, 2009

(65) Prior Publication Data

US 2009/0324290 A1 Dec. 31, 2009

(30) Foreign Application Priority Data

Jun. 30, 2008 (JP) ..... 2008-170009

(51) Int. Cl.
*G03G 15/02* (2006.01)

(52) U.S. Cl. ..... 399/174

(58) Field of Classification Search ..... 399/174, 399/175, 176

See application file for complete search history.

(56) References Cited

FOREIGN PATENT DOCUMENTS

| | | |
|---|---|---|
| JP | 04-249270 | 9/1992 |
| JP | 05-281827 | * 10/1993 |
| JP | 7-49600 | 2/1995 |
| JP | 7-281507 | 10/1995 |
| JP | 8-137190 | 5/1996 |

* cited by examiner

*Primary Examiner* — Hoang Ngo
(74) *Attorney, Agent, or Firm* — Rabin & Berdo, PC

(57) ABSTRACT

A charging apparatus includes a charging member and at least one projection formed on the charging member. The charging member includes a surface that faces the surface of a photoconductive body. The at least one projection is formed on the first surface to extend in a direction parallel to the longitudinal direction of the photoconductive body. The projection is in contact with the surface of the photoconductive body.

16 Claims, 10 Drawing Sheets

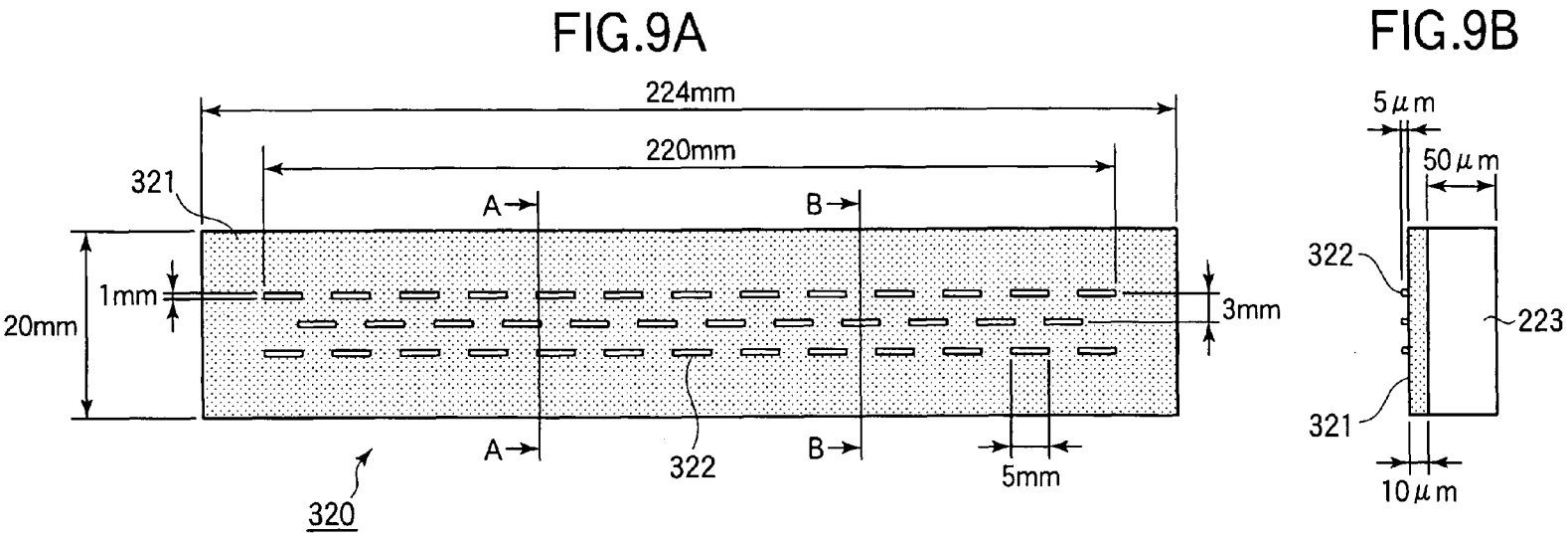
FIG.9A
224mm
220mm
3mm
5mm
B
B
A
A
322
320
321
1mm
20mm
FIG.9B
223
50μm
5μm
10μm
322
321
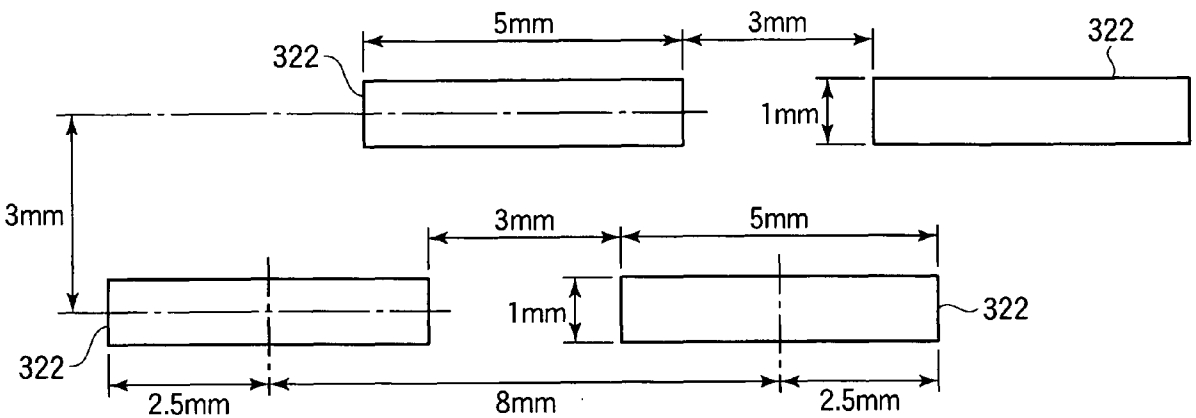
FIG.9C
322
3mm
1mm
5mm
322
3mm
322
5mm
2.5mm
3mm
1mm
8mm
2.5mm
322

CHARGING APPARATUS, PRINT ENGINE THAT INCORPORATES THE CHARGING APPARATUS, AND IMAGE FORMING APPARATUS THAT INCORPORATES THE PRINT ENGINE

BACKGROUND OF THE INVENTION

1. Field of the Invention

The present invention relates to a charging apparatus, a print engine that incorporates the charging apparatus, and an image forming apparatus that incorporates the print engine. An image bearing body is charged to a desired potential and is then irradiated with light to form an electrostatic latent image on the image bearing body. The electrostatic latent image is developed with a developer material into a visible image. Such image forming apparatuses include copying machines, printers, and facsimile machines.

2. Description of the Related Art

Among conventional charging apparatuses that charge a photoconductive body is one in which a charging film member has one end portion fixed to an apparatus body and another end portion in pressure contact with a photoconductive body by the use of the spring action or resiliency of the film. A voltage is applied to the charging film, which in turn charges the surface of the photoconductive body.

A high speed image forming apparatus uses a low-melting point toner. Low-melting point toner is apt to adhere to surrounding structural members. In order to prevent adhesion of the low-melting point toner to the surroundings, a large amount of external additive such as silica is added to the toner. The external additive and toner that have failed to be transferred onto a recording medium during transferring remain on the photoconductive body. As the photoconductive body continues to rotate, the external additive and toner are carried to a charging member disposed downstream of the transfer point. Even if the resiliency of the charging film is controlled in a conventional manner, it is still difficult to prevent the external additive from being trapped in gaps between the charging film and the photoconductor. This causes variations in the electrical discharge that takes place between the charging film and the photoconductive body, resulting in poor charging performance of the photoconductive body. Poor charging performance may result in white streaks on a printed image, impairing print quality of the image.

SUMMARY OF THE INVENTION

An object of the invention is to solve the drawbacks of conventional apparatuses.

Another object of the invention is to provide a charging apparatus, a print engine, and an apparatus in which charging of a photoconductive body is not impaired by particles of additive carried on the photoconductive body.

A charging apparatus includes a charging member and at least one projection formed on the charging member. The charging member includes a surface that faces the surface of a photoconductive body. The at least one projection is formed on the first surface to extend in a direction to the longitudinal direction of the photoconductive body. The projection is in contact with the surface of the photoconductive body.

The surface of the charging member is in contact with the surface of the surface of the photoconductive body at a position upstream of the position at which the projection is in contact with the photoconductive body. A gap is formed between the charging member and the photoconductive body upstream of the position at which the charging member is in contact with the photoconductive body. A gap is formed between the charging member and the photoconductive body downstream of the position at which the charging member is in contact with the photoconductive body.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 9A is a top view illustrating the overall outline of the charging film of a second embodiment;

FIG. 9B is a side view of the charging film of FIG. 9A;

FIG. 9C is a partial expanded view illustrating the dimensional relations among projections of the charging film of FIG. 9A;

DETAILED DESCRIPTION OF THE INVENTION

First Embodiment

Configuration of Printer

Figure 1:
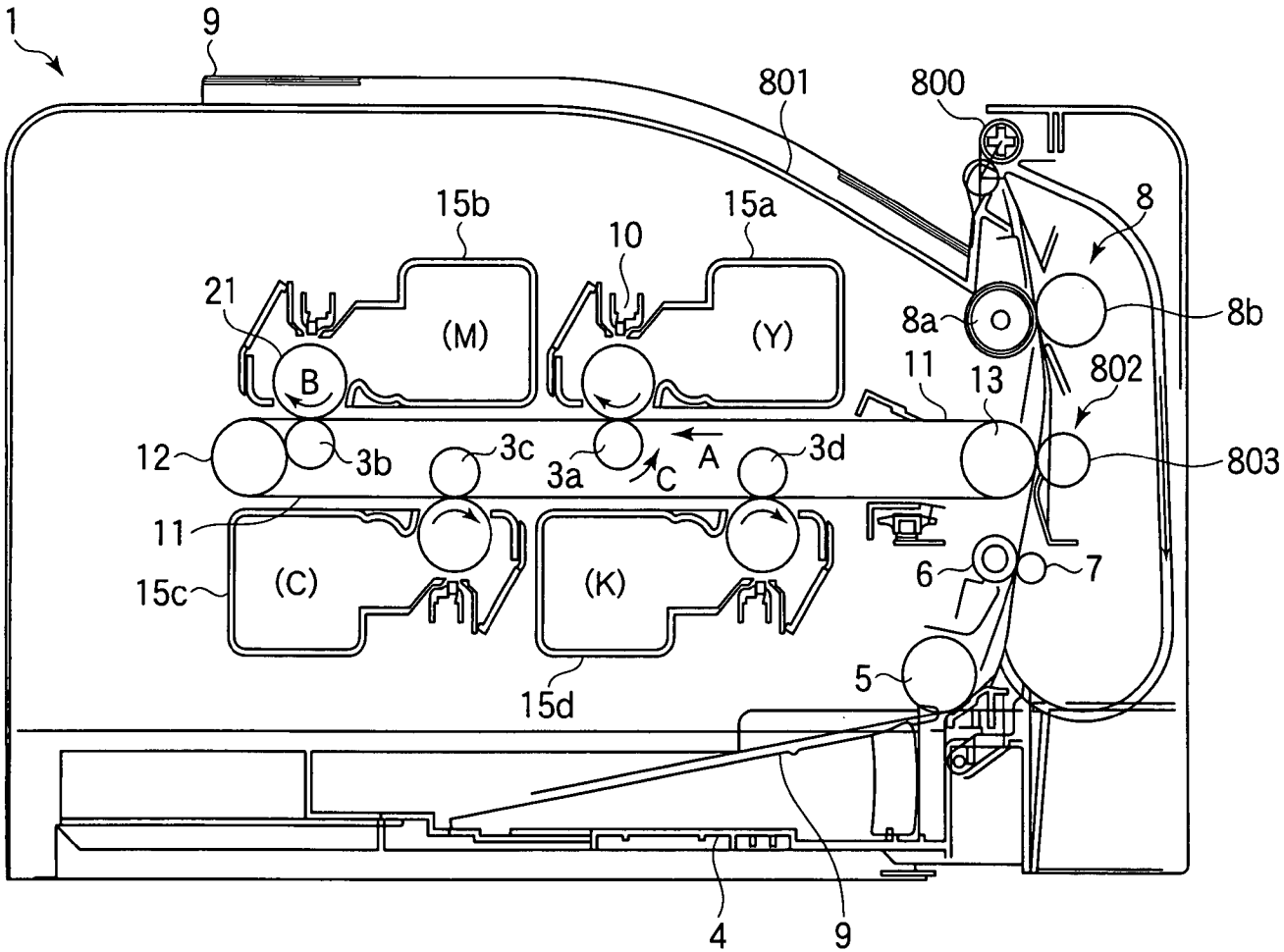
FIG. 1 illustrates the general configuration of a printer of a first embodiment.

FIG. 1 illustrates the general configuration of an image forming apparatus 1 of a first embodiment in which a print engine is equipped with a charging apparatus of the invention and is adapted for quickly mounting on and releasing from the image forming apparatus 1.

Referring to FIG. 1, the image forming apparatus 1 is an electrophotographic printer capable of printing yellow (Y), magenta (M), cyan (C), and black (K) images. A paper cassette 4 is disposed upstream end of a transport path in which paper 9 is transported, and holds a stack of paper 9. A hopping roller 5 is disposed over the paper cassette 4, and advances the top page of the stack into the transport path. A registry roller 6 is disposed downstream of the hopping roller 5, and cooperates with a pinch roller 7 to correct the skew of the paper 9 before the paper 9 is fed into the print engines.

A transfer belt 11 is disposed about a drive roller 12 and a tension roller 13. When a drive force is transmitted from a drive source (not shown) through, for example, a gear train to the drive roller 12, the transfer belt 11 is driven to run in a direction shown by arrow A. A yellow print engine 15*a*, a magenta print engine 15*b*, a cyan print engine 15*c*, and a black print engine 15*d* are aligned in this order along the transfer belt 11, surrounding the transfer belt 11 as shown in FIG. 1. Alternatively, the print engines 15*a*-15*d* may be aligned in a straight line along the transfer belt 11.

Figure 2:
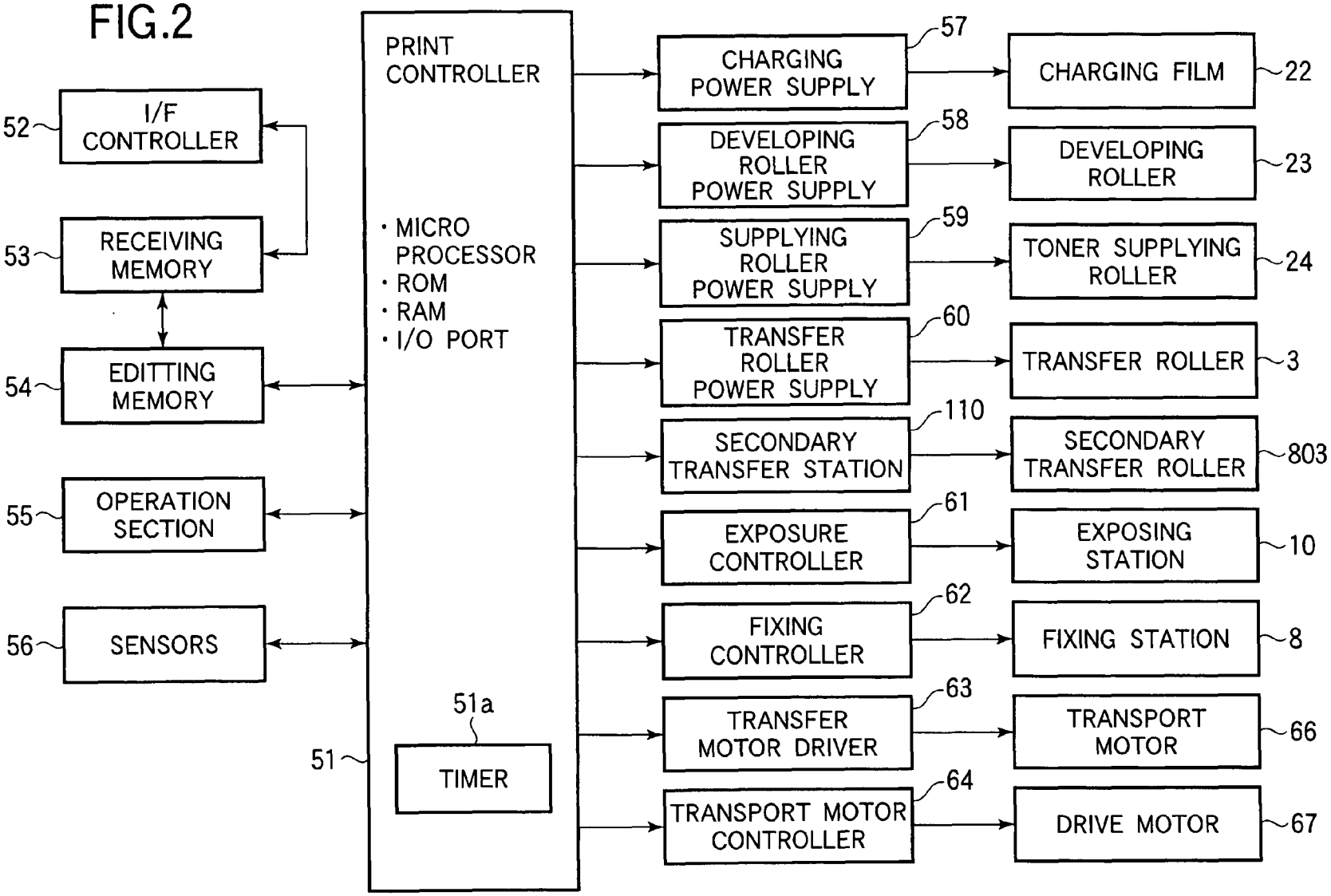
FIG. 2 is a block diagram illustrating a pertinent configuration of a control system of the invention.

The print engines 15*a*-15*d* each include a corresponding photoconductive body or photoconductive drum 21. The photoconductive drums 21 parallel corresponding transfer rollers 3*a*-3*d*, and are in pressure contact with the transfer rollers 3*a*-3*d*. These mechanisms are controlled by a print controller 51 (FIG. 2).

When the transfer belt 11 passes through transfer points defined between the transfer rollers 3*a*-3*d* and the photoconductive drum of the print engines 15*a*-15*d*, toner images of the respective colors are transferred onto the transfer belt 11. As described later, the toner images are transferred onto the transfer belt 11 one over the other in registration to form a full color toner image, and are then transferred onto the paper 9 at a secondary transfer station 802. Then, the paper 9 having the full color toner image thereon is transported to a fixing station 8.

The fixing station 8 includes a heat roller 8*a* and a backup roller 8*b*. When the paper 9 passes through a fixing point defined between the heat roller 8*a* and the backup roller 8*b*, the full color toner image is fused by heat and pressure into a permanent full color image. Then, the paper 9 is discharged by a discharge roller 800 onto a stacker 801.

The print engines 15*a*-15*d* are identical in configuration and differ only in the color of toner. For simplicity's sake, the construction will be described in terms of the yellow print engine 15*a*, it being understood that the remaining print engines 15*b*-15*d* may work in a similar fashion.

{Control Block Diagram}

FIG. 2 is a block diagram illustrating a pertinent configuration of the control system of the invention.

Referring to FIG. 2, a print controller 51 primarily includes a micro processor, a ROM, a RAM, an input/output port, and a timer. The print controller 51 receives print data and control commands from a host apparatus (not shown) via an interface controller (hereinafter I/F controller) 52, and controls the overall sequence of image formation during printing. A receiving memory 53 receives the print data through the I/F controller 52 and temporarily holds the print data therein. An editing memory 54 receives the print data from the receiving memory 53, and is used to edit the print data to produce image data.

An operation section 55 includes LEDs that indicate the various statuses of the image forming apparatus 1, and switches through which an operator inputs commands into the image forming apparatus 1. Sensors 56 include various sensors that monitor the operation statuses of the image forming apparatus 1. Sensors 56 include, for example, paper position sensors, temperature/humidity sensors, and a density sensor. Power supplies 57-60 and 110 apply voltages to corresponding sections in response to the commands received from the print controller 51. For example, the charging power supply 57 applies a voltage to a charging member or a charging film 22 so that the charging film 22 charges the circumferential surface of the photoconductive drum 21. The charging film 22 is formed of a resilient material, for example, PET resin or rubber, and has a Young's modulus in the range of 1 to 5 Gpa.

An exposure controller 61 sends the image data from the edit memory 54 to an exposing station 10, which in turn controls the light sources in accordance with the image data. The fixing station 8 includes the heat roller and a temperature sensor (not shown). The heat roller 8*a* fuses the toner image on the paper 9. The temperature sensor detects the temperature of the heat roller. A fixing controller 62 reads the output of the temperature sensor, and energizes the heater according to the output of the temperature sensor, thereby maintaining a heat roller 8*a* (FIG. 1) of the fixing apparatus 8 at a constant temperature.

A transport motor driver 63 drives a transport motor 66 in rotation under the command received from the print controller 51, so that the paper 9 is advanced and stopped at predetermined points of time. The drive controller drives a drive motor 67 in rotation, thereby controlling the photoconductive drum 21, a developing roller 23, a toner supplying roller 24, and the transfer roller 3*a* to rotate in synchronism with one another in directions shown by arrows B, D, E, and C (FIG. 3), respectively.

{Print Engine}

Figure 3:
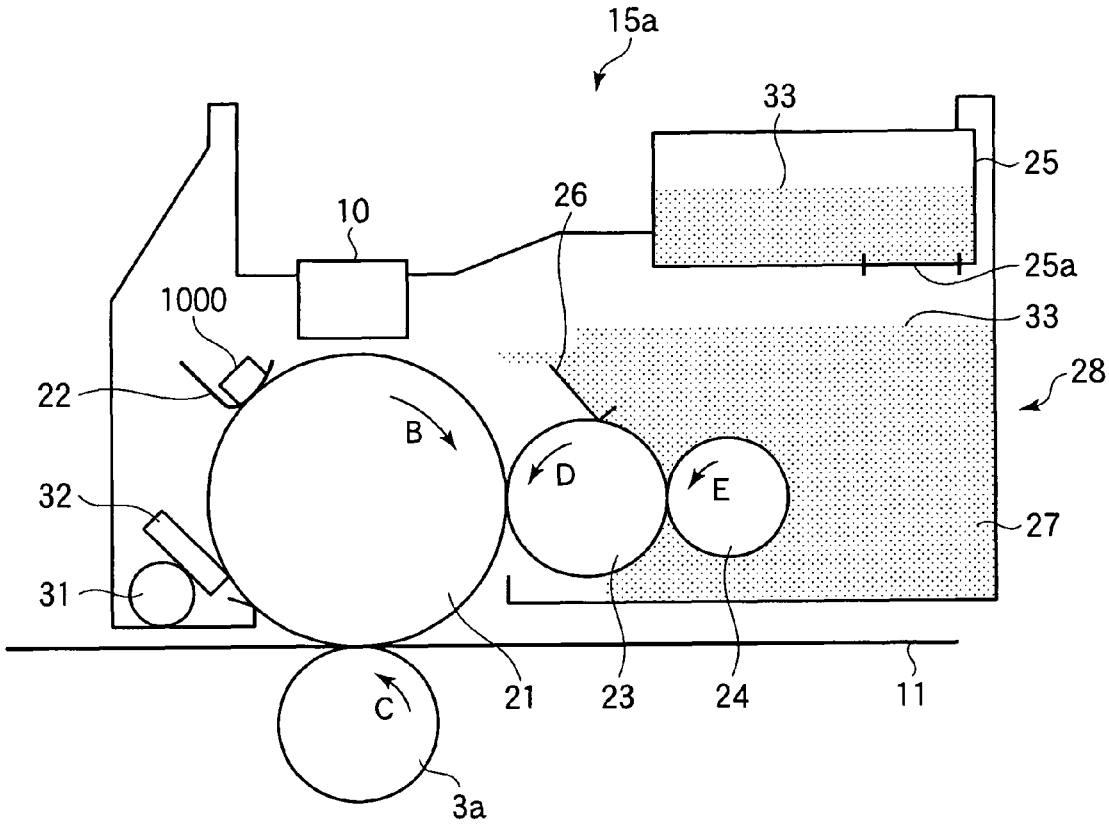
FIG. 3 illustrates a pertinent portion of the print engine for yellow images.

FIG. 3 illustrates a pertinent portion of the print engine 15*a* for yellow image together with the exposing station 10, the transfer roller 3*a*, and the transfer belt 11.

Referring to FIG. 3, the print engine 15*a* includes the photoconductive drum 21 that rotates in a direction shown by arrow B. A drive force is transmitted to the photoconductive drum 21 through a gear located on the body side of the image forming apparatus 1 and a gear formed on a flange (not shown) on the photoconductive drum 21 side.

The resilient charging film 22 contacts the circumferential surface of the photoconductive drum 21 to supply charges to the circumferential surface of the photoconductive drum 21, thereby uniformly charging the circumferential surface of the photoconductive drum 21.

The exposing station 10 is located on the body side of the image forming apparatus 1, and employs LEDs as a light source. The exposing station 10 is disposed downstream of the charging film 22. The exposing station 10 irradiates the charged surface of the photoconductive drum 21 with light in accordance with the image data, thereby forming an electrostatic latent image on the surface of the photoconductive drum 21.

The developing roller 23 is disposed downstream of the exposing station 10 with respect to rotation of the photoconductive drum 21. A developing station 28 includes the developing roller 23, a toner supplying roller 24, a toner cartridge 25, a developing blade 26, and a toner reservoir 27. The toner reservoir 27 holds the toner 33 therein. An external additive such as silica or titanium oxide has a diameter on the order of several nanometers, and is added to the toner 33. The toner 33 is positively charged in the first embodiment.

The toner cartridge 25 holds the toner 33 therein, and is adapted for quickly mounting on and releasing from the print engine 15*a*. The toner 33 is supplied from the toner cartridge 25 through a toner discharging opening 25*a* into the toner reservoir 27 of the print engine 15*a*. The toner supplying roller 24 includes a metal shaft covered with a foamed silicon rubber material, and holds the toner thereon. The toner supplying roller 24 rotates in a direction shown by arrow E to supply the toner 33 to the developing roller 23. The developing roller 23 includes a metal shaft covered with solid urethane rubber, and rotates in contact with the photoconductive drum 21 in a direction shown by arrow D.

The developing blade 26 has a tip portion in pressure contact with the circumferential surface of the developing roller 23 under a predetermined line pressure, thereby forming a thin layer of the toner 33 on the developing roller 23. The developing blade 26 is formed by bending a sheet of stainless steel. The bent portion applies a line pressure on the developing roller 23. The developing power supply 58 (FIG. 2), which will be described later, applies a d-c voltage of −200 V to the developing roller 23 such that the layer of toner on the developing roller 23 is charged to a potential in the range of −50 to −100 V, thereby depositing the toner 33 to the electrostatic latent image.

The transfer roller 3*a* is disposed downstream of the developing roller 23, and is urged against the photoconductive drum 21 with the transfer belt 11 sandwiched between the transfer roller 3*a* and the photoconductive drum 21 to define the transfer point therebetween. The toner image is transferred onto the transfer belt 11 by the transfer roller 3*a*. A cleaning blade 32 is disposed downstream of the transfer roller 3*a*, and removes residual toner from the photoconductive drum 21 after transferring. The residual toner is scraped by the cleaning blade 32, then falls into the toner reservoir 31, and is then collected into a waste toner reservoir.

{Charging Station}

Figure 4:
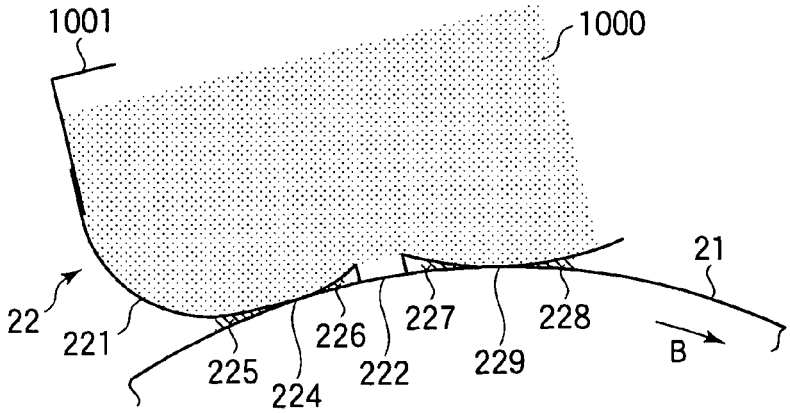
FIG. 4 is an enlarged view illustrating the positional relation among a charging film, a support, a urethane sponge, and a photoconductive drum.

FIG. 4 is a cross-sectional side view illustrating the positional relation among the charging film 22, a support 1001, a urethane sponge 1000, and the photoconductive drum 21.

Referring to FIG. 4, the charging film 22 has one widthwise end permanently fixed at a predetermined position in the print engine 15*a* by means of the support 1001. The support 1001 is formed by bending an electrically conductive material, for example, a metal material. A charging power supply 57 (FIG. 2) applies a voltage to the support 1001, so that electrical discharge takes place between the charging film 22 and the photoconductive drum 21.

The urethane sponge 1000 urges the charging film 22 against the photoconductive drum 21 such that the free end portion of the charging film 22 extends downstream of a point at which the charging film 22 is tangent to the circumferential surface of the photoconductive drum 21. The urethane sponge 1000 exhibits resiliency, and is supported by a support member (not shown) such that the urethane sponge 1000 is compressed by, for example, approximately 1 mm toward the photoconductive drum 21, thereby urging the charging film 22 against the surface of the photoconductive drum 21.

The charging film 22 has one widthwise end fixed to the support 1001 such that a widthwise free end of the charging film 22 extends downstream, with respect to rotation of the photoconductive drum 21, of a point at which the charging film 22 is tangent to the circumferential surface of the photoconductive drum 21, and such that curved surfaces of the charging film 22 are in contact with the circumferential surface of the photoconductive drum 21. The charging film 22 has a second position or a first contact area 224, the projection 222, and a second contact area 229, all being in contact with the circumferential surface of the photoconductive drum 21. The first contact area 224 is upstream of the projection 222. The second contact area 229 is downstream of the projection 222. It is to be noted that there are small gaps 225 and 226 between the charging film 22 and the photoconductive drum 21, small gaps 225 and 226 being defined immediately upstream and immediately downstream of the first contact area 224 with respect to rotation of the photoconductive drum 21, respectively. Likewise, it is to be noted that there are small gaps 227 and 228 between the charging film 22 and the photoconductive drum 21, the small gaps 227 and 228 being defined immediately upstream and immediately downstream of the second contact area 229 with respect to rotation of the photoconductive drum 21, respectively. The distances between a first surface or a surface layer 221 and a second surface or the circumferential surface of the photoconductive drum 21 are sufficient for ensuring electrical discharge.

Electrical discharge takes place in the gaps 225, 226, 227, and 228 formed between the surface layer 221 of the charging film 22 and the photoconductive drum 21, so that charges are stored on the circumferential surface of the photoconductive drum 21. The larger the number of small gaps, the more easily the photoconductive drum 21 is charged.

{Charging Film}

Figure 5B:
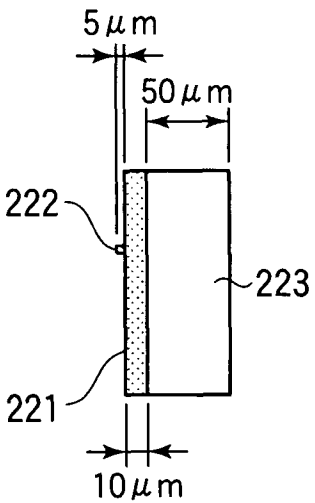
FIGS. 5A and 5B illustrate the shape of the charging film, FIG. 5A being a front view and FIG. 5B being a side view.
Figure 5A:
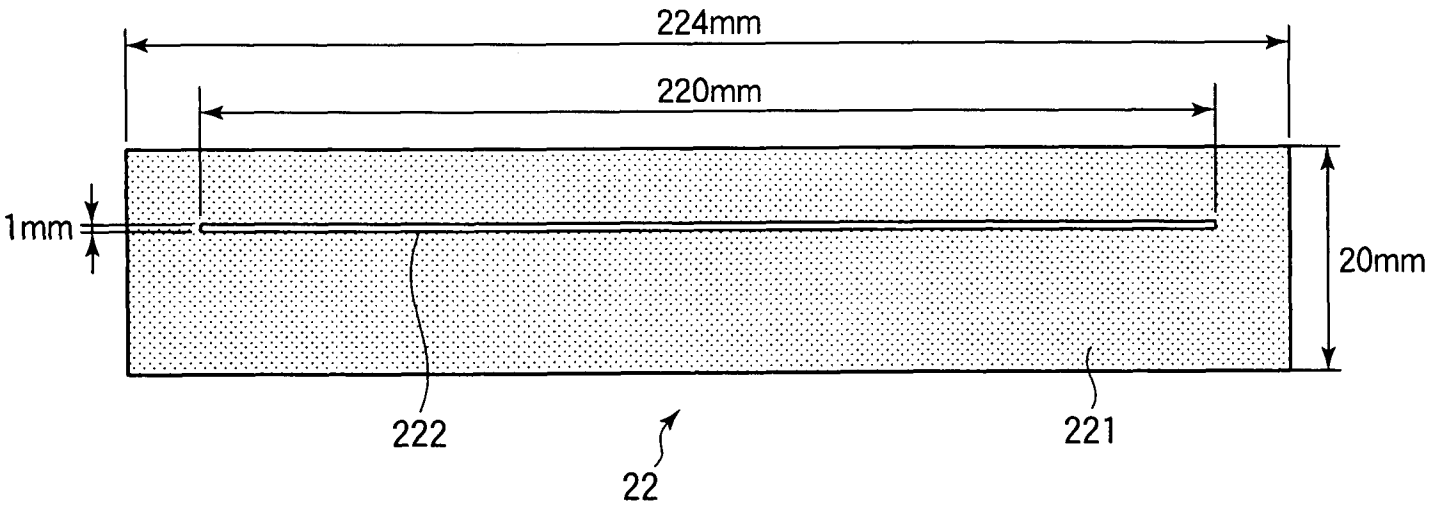

FIGS. 5A and 5B illustrate the configuration of the charging film 22. FIG. 5A is a front view and FIG. 5B is a side view. The charging film 22 will be described in more detail with reference to FIGS. 5A and 5B.

The charging film 22 extends along the photoconductive drum 21 (FIG. 4) in a longitudinal direction. The charging film 22 is 224 mm long, 20 mm wide, and approximately 60 μm thick. The charging film 22 includes a flexible polyethylene terephthalate (PET) film 223 and a surface layer 221 having a thickness of approximately 10 μm. The surface layer 221 is formed on the PET film 223 by applying an electrically conductive coating over one entire side surface of the PET film 223, and is connected to a power supply such that electrical discharge takes place between the surface layer 221 and the photoconductive drum 21. A projection 222 is 5 μm high, 220 mm long, and 1 mm wide, and is formed on the surface layer 221 to extend all across the length of the surface layer 221 or across the entire width of an image area on the photoconductive drum. The projection 222 contacts the circumferential surface at a first position or a predetermined position on of the photoconductive drum 21. The charging film 320 shown in FIGS. 5A and 5B is not drawn to accurate scale but is exaggerated for the sake of illustration only.

An electrically conductive coating is applied to the PET film 223 by screen printing to form the surface layer 221 and the projection 222. Then, the charging film 22 is processed so that the electrically conductive coating is set. The electrically conductive coating may be prepared by mixing a binder with an electrical conductive agent. The binder may be polyester, polyurethane, vinyl chloride material, phenol resin, acrylic, or epoxy. The electrical conductive agent may be silver, copper, nickel, or carbon.

If the surface layer 221 has too low an electrical resistance, current may leak into "pin holes" caused by scratches in the circumferential surface of the photoconductive drum 21. The leakage current I is given as follows:

$$I=V/R$$

where V is the voltage applied to the surface layer 221, I is the leakage current, and R is the electrical resistance of the surface layer 221.

If the surface layer 221 has too high an electrical resistance, discharge current decreases to reduce the amount of charge deposited on the photoconductive drum 21 during electrical discharge. Thus, the electrical resistance of the coating should be in the range of $10^3$ to $10^8\Omega$.

The base material of the charging film 22 is the PET film 223. However, the material is not limited to this but may be a film of, for example, polyester, polycarbonate, or polyimide.

If the base material is an electrically conductive agent such as polycarbonate, polyimide, ethylene tetrafluoroethylene (ETFE), or polyvinylidene fluoride (PVDF), coating is not necessary to form the surface layer 221.

The projection 222 may also be formed of an insulating ink since electrical discharge takes place in very minute gaps defined by the surface layer 221 other than the projection 222.

Figure 6:
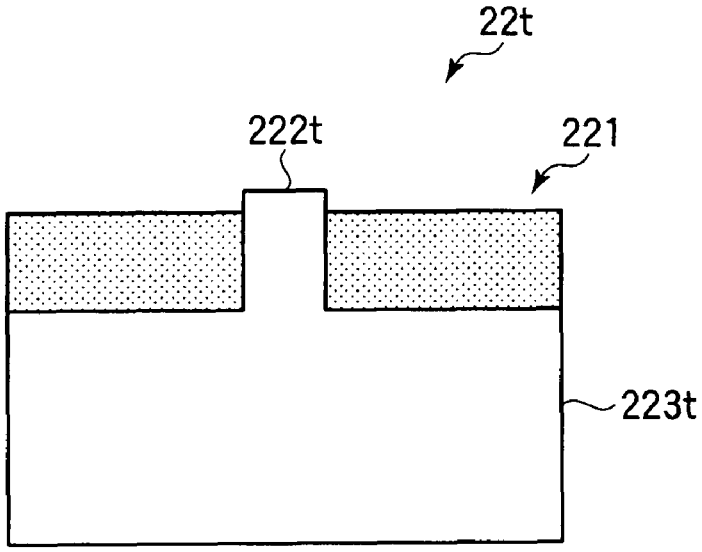
FIG. 6 illustrates the external additive that has crowded together in a small gap.

FIG. 6 illustrates another charging film 22*t*. Alternatively, a charging film 22*t* shown in FIG. 6 may be used. The surface layer 221 may be implemented by applying an electrically conductive agent to a film 223*t* having a projection 222*t* formed thereon.

Referring back to FIG. 3, the charging film 22 is pressed against the photoconductive drum 21 by pushing the urethane sponge 1000 toward the photoconductive drum 21 to deform by about 1 mm, the free end portion of the charging film 22 extending downstream of the support 1001 with respect to rotation of the photoconductive drum 21. However, the invention is not limited to this. The charging film 22 may be maintained in pressure contact with the photoconductive drum 21 by means of the resiliency and rigidity of the charging film 22 as long as the gaps for electrical discharge may be ensured. In order to form gaps immediately upstream and downstream of the projection and the contact areas of the charging film 22 with respect to the rotation of the photoconductive drum 21, it is preferable that the charging film 22 is pressed from behind against the photoconductive drum 21 so that the projection and surface areas of the charging film 22 in the vicinity of the projection are in pressure contact with the photoconductive drum 21.

{Operation of Print Engine and Charging Film}

The operation of the print engines 15*a*-15*d* will be described.

Referring to FIG. 1, the hopping roller 5 advances the top sheet of the stack of the paper 9, held in the paper cassette 4, into a transport path. The registry roller 6 corrects the skew of the paper 9, then the paper 9 advances to a secondary transfer station 802. In the mean time, the print engines 15*a*-15*d* form electrostatic latent images of the corresponding colors, and develop the electrostatic latent images with the toner of corresponding colors. As the transfer belt 11 passes in sequence through the transfer points defined between the photoconductive drums 21 and corresponding transfer rollers 3*a*, the toner images of the respective colors are transferred onto the transfer belt 11 one over the other in registration.

The superposed toner images are then transferred at the second transfer station 802 from the transfer belt 11 onto the paper 9 by means of a secondary transfer roller 803. Then, the fixing station 8 fixes the toner images into a full color permanent image. Finally, the paper 9 is discharged onto the stacker 801 after fixing. This completes printing.

The operation of print engines 15*a*-15*d* will be described is more detail.

Referring to FIG. 4, the photoconductive drum 21 rotates in the B direction and electrical discharge takes place between the photoconductive drum 21 and the surface layer 221 of the charging film 22. At this moment, a voltage of −1000 V is applied to the charging film 22 so that the circumferential surface of the photoconductive drum 21 is substantially uniformly charged to −500 V. Thereafter, the exposing station 10 (FIGS. 2 and 3) selectively illuminates the uniformly charged surface of the photoconductive drum 21 in accordance with the image data to form an electrostatic latent image. Irradiating the charged areas with light dissipates the charges in the illuminated areas, so that the potential of the illuminated areas differs from that of the non-illuminated areas.

A d-c voltage of −200 V is applied to the developing roller 23 so that as the photoconductive drum 21 rotates, the electrostatic latent image is brought into contact with the toner 33 on the developing roller 23. Accordingly, the toner 33 is attracted to the electrostatic latent image to form a toner image. A transfer voltage is applied to the transfer roller 3*a* so that the toner image is transferred onto the transfer belt 11. The cleaning blade 32 scrapes the residual toner from the photoconductive drum 21 after transferring of the toner image, and is collected into a waste toner reservoir 31.

{Operation of Charging Film}

The operation of the charging film 22 will be described in detail.

The photoconductive drum 21 is charged by the electrical discharge between the photoconductive drum 21 and the surface layer 221 of the charging film 22 (FIG. 3). If the size of the small gaps 225-228 (i.e., the distance between the charging film 22 and photoconductive drum 21) is in a predetermined range, electrical discharge will take place in the small gaps 225-228 between the photoconductive drum 21 and the surface layer 221. If the size of the small gaps 225-228 is not in the predetermined range, electrical discharge will not take place. Also, electrical discharge does not take place in areas depicted by 222, 224, and 229 where the charging film 22 is in contact with the photoconductive drum 21. Thus, the charging of the photoconductive drum 22 is performed in the small gaps 225-228 which are in the predetermined range of size.

The size of the gaps in which electrical discharge can take place depends on the voltage applied to the charging film 22. Experience shows that electrical discharge takes place if the size of the gaps is in the range of several microns to 20 microns, more preferably 3-10 μm, providing that a voltage of −1000 V is applied to the discharging film 22. In other words, the size of the gaps between the surface of the photoconductive drum 21 and the surface layer 221 of the charging film 22 should be maintained in a range suitable for electrical discharge to take place.

The charging film 22 contacts the photoconductive drum 21 at the first contact area 224, second contact area 229, and projection 222. These contact areas and projection form the small gaps 225-228 (hatched areas shown in FIG. 4) between the photoconductive drum 21 and the surface layer 221.

If printing is performed repeatedly, the external additive of the residual toner particles remaining on the photoconductive drum 21 will crowd together at the gap area 225 in the vicinity of areas in which the charging film 22 is in contact with the photoconductive drum 21.

Figure 7:
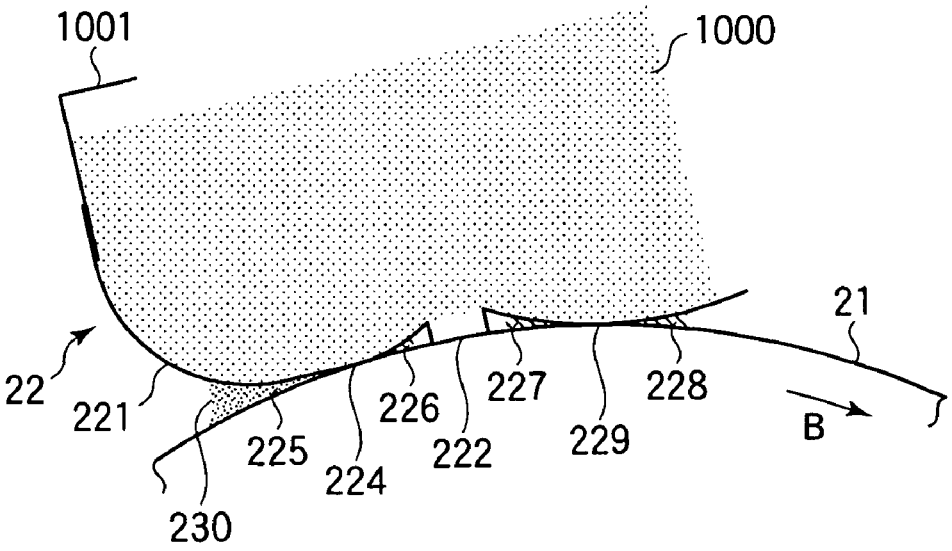
FIG. 7 illustrates another charging film.

FIG. 7 illustrates the external additive that has crowded together in the small gap 225.

Referring to FIG. 7, the external additive is blocked at a contact area upstream of the first contact area 224 with respect to rotation of the photoconductive drum 21, becoming a build-up 230.

The coating of the charging film 22 has a high electrical resistance in the range of $10^3$ to $10^8\Omega$. The material having a high electrical resistance is selected for the external additive, thereby minimizing leakage of the charges stored on the toner particles acquired by triboelectric charging. Thus, the build-up 230 in the gap 225 formed between the photoconductive drum 21 and the charging film 22 also exhibits a high electrical resistance during electrical discharge between the photoconductive drum 21 and the charging film 22. In addition, the distribution of the amount of toner consumed during printing is not uniform in the longitudinal direction of the photoconductive drum 21. The amount of external additive is distributed in proportion to the amount of consumed in the longitudinal direction, and is therefore not uniform in the longitudinal direction of the photoconductive drum 21.

The high electrical resistance of the build-up 230 affects the electrical discharge that takes place between the photoconductive drum 21 and the surface layer 221 of the charging film 22, so that the amount of electrical discharge is not uniform in the longitudinal direction of the photoconductive drum 21. In addition, the free end portion of the charging film 22 may vibrate irregularly during printing, so that the amount of small gap 228 formed in the vicinity of the free end portion may be unstable. Instability of the small gaps 228 leads to unstable electrical discharge. Therefore, the build-up 230 and vibration of the charring film 22 can be sources of unstable electrical discharge.

{Comparison}

Figure 13:
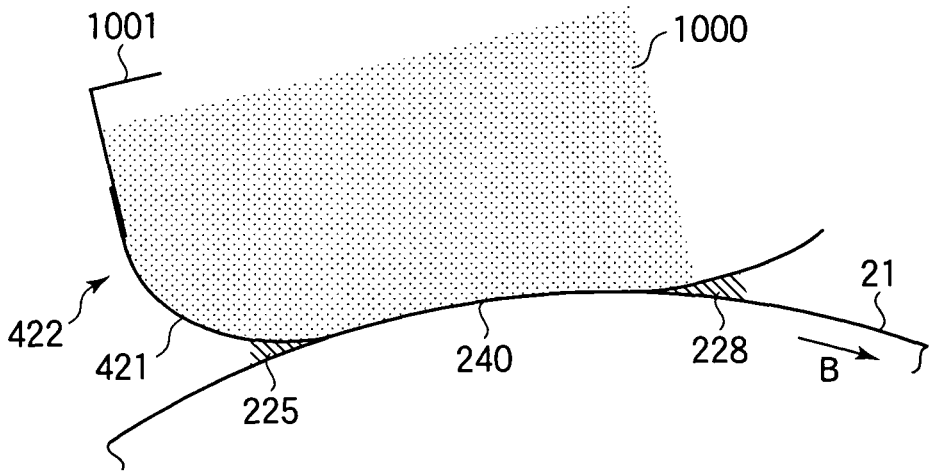
FIG.13 CONVENTIONAL ART
FIG. 13 illustrates the configuration of a conventional charging film.

FIG. 13 illustrates the configuration of a conventional charging film 422 that has not a projection, and the operation of the charging film 422 in contact with the photoconductive drum 21. The charging film 422 has large areas 240 in contact with the circumferential surface of the photoconductive drum 21, and therefore only gaps 225 and 228 are formed between the charging film 422 and the photoconductive drum 21.

Figure 14:
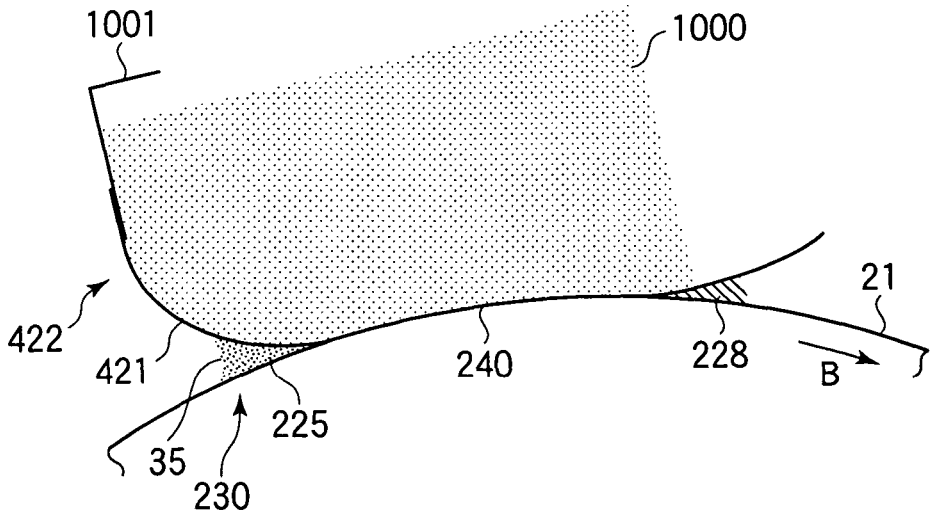
FIG.14 CONVENTIONAL ART
FIG. 14 illustrates the conventional charging film.

FIG. 14 illustrates a conventional charging film 422. Referring to FIG. 14, repetitive printing operations cause the build-up 230*a* to grow in the small gap 225 just as in the charging film 22 shown in FIG. 7. The amount of electrical discharge in the small gap 225 is distributed in the longitudinal direction of the photoconductive drum 21 just as in the charging film 22. Also, the size of the gaps (i.e., the distance between the charging film and the photoconductive drum 21) that causes electrical discharge in the vicinity of the free end portion may vary due to vibration of the free end portion during printing, so that stable electrical discharge may not be obtained.

As described above, because the conventional charging film 422 has not a projection formed thereon as opposed to the charging film 22 of the first embodiment, when the build-up 230 begins to grow in the small gap 225 due to repetitive printing operations, stable electrical discharge may not be ensured in the small gaps 225 and 228. As a result, the surface of the photoconductive drum 21 may not be uniformly charged to a predetermined voltage.

In contrast to the conventional charging film 422, the charging film 22 of the first embodiment provides the small gaps 226 and 227 in addition to the small gaps 225 and 228. The electrical discharge developed in the small gaps 226 and 227 is not affected by the build-up 230 and/or by vibration of the free end of the charging film 22, thus providing stable charging of the photoconductive drum 21.

{Modification of Charging Film}

Figure 8B:
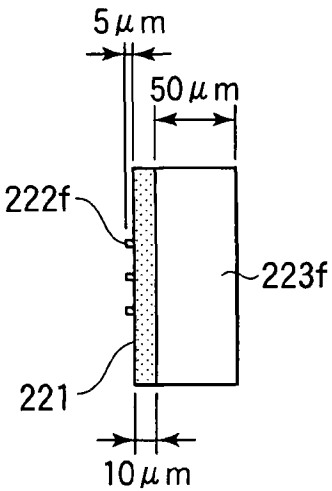
FIGS. 8A and 8B illustrate a modification to the charging film of the first embodiment.
Figure 8A:
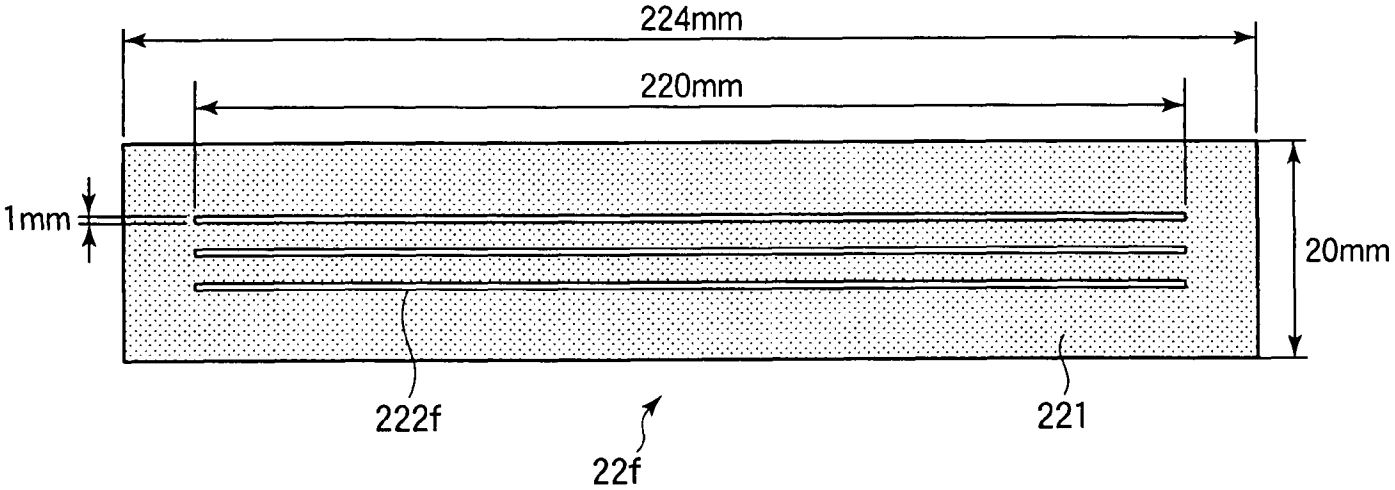

FIGS. 8A and 8B illustrate a modification to the charging film 22.

The charging film 22 includes the single projection 222 that extends in the longitudinal direction of the charging film 22 as shown in FIG. 5A. However, the invention is not limited to this. For example, three parallel projections 222*f* may be provided as shown in FIGS. 8A and 8B, thereby increasing the number of small gap areas where electrical discharge is not affected by the build-up 230 and/or the vibration of the free end portion of the charging film 22. The spacing of the projections 222*f* or the distance between adjacent projections 222*f* may be selected according to the curvature of the photoconductive drum 21 and the method of fixing the charging film 22, thereby ensuring a plurality of small gap areas. Experiment reveals that stable small gap areas may be obtained using a distance in the range of 0.5 to 10 mm, more preferably in the range of 1 to 3 mm.

The preferred height of the projection 222 varies depending on the voltage applied to the charging film 22. Therefore, the height of the projection 222 should be selected according to the voltage applied to the charging film 22. In the first embodiment, a voltage of −1000 V is applied to the charging film 22, and the preferred height is in the range of 3 to 10 μm accordingly.

The print engines 15*a*-15*d* are configured such that the toner cartridge 25 is disposed above the developing roller 23 and adapted for quickly mounting on and releasing from the print engine. The present invention is not limited to this configuration. For example, the present invention may be applicable to a print engine that incorporates a toner holding section permanently attached to the print engine.

The projection of the first embodiment is in the shape of a rectangular prism. The present invention is not limited to this configuration. For example, the projection may be in the shape of a triangular prism, a cylinder, or any other shape as long as the projection provides gaps that cause electrical discharge to take place between the charging film 22 and the photoconductive drum 21.

As described above, the charging film 22 includes a projection that contacts the photoconductive drum 21, so that the photoconductive drum 21 may be reliably charged without being affected by the build-ups of external additive of the toner particles and vibration of the free end portion of the charging film 22. Thus, the circumferential surface of the photoconductive drum 21 may be charged uniformly to a desired potential.

Second Embodiment

FIGS. 9A-9C illustrate a charging film 320 for use in a print engine of a second embodiment. FIG. 9A is a top view illustrating the outline of the charging film 320. FIG. 9B is a side view of the charging film 320. FIG. 9C is a partial expanded view illustrating the dimensional relations among the projections.

The charging film 320 differs from the charging film 22 in shape. Thus, the image forming apparatus 1 and print engines 15*a*-15*c* of the first embodiment are also used in the second embodiment. Thus, the detailed description of the image forming apparatus 1 and print engines 15*a*-15*c* are omitted. The second embodiment will be described with reference to FIGS. 1 and 2 as required.

The charging film 320 of the second embodiment differs from the charging film 22 (FIG. 4) of the first embodiment in the arrangement of projections 322. The projections 322 are each 5 mm long, 1 mm wide, and 5 μm high. The projections 322 are arranged in three parallel rows such that the projections 322 in each row are arranged at a pitch (center-to-center distance) equal to or shorter than twice the length of the projection 322, and such that the projections 322 in one of two adjacent rows are staggered by a half the center-to-center distance of adjacent projections with respect to the projections 322 in the other of the two adjacent rows. Each projection 322 in one of two adjacent rows overlaps two adjacent projections 322 in the other of the two adjacent rows. The three rows extend across the width (e.g., 220 mm) of an image bearing area in a longitudinal direction of a photoconductive drum 21. The charging film 320 shown in FIG. 9A is not drawn to accurate scale but is exaggerated for the sake of illustration only.

A description will be given of an image forming apparatus that employs a print engine (FIG. 3) incorporating the charging film 320 therein.

Figure 10A:
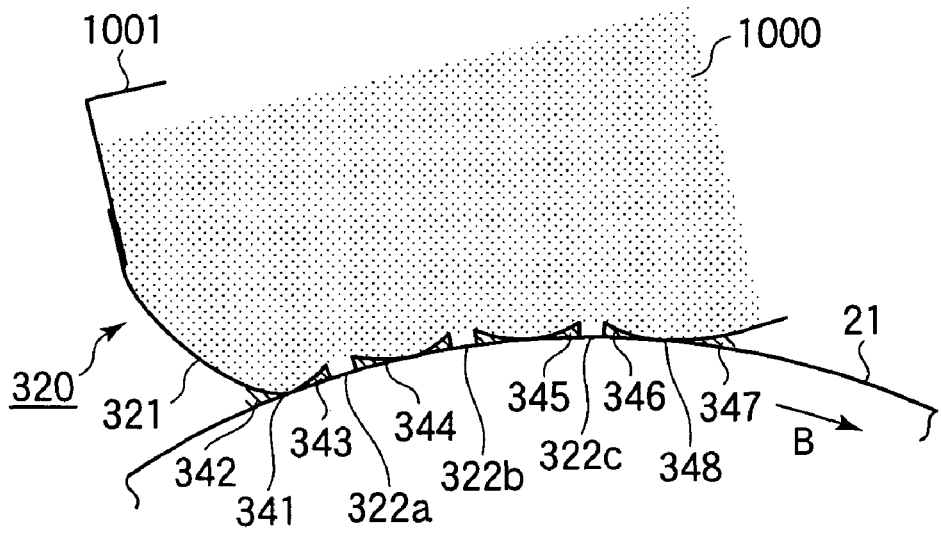
FIG. 10A is a cross-sectional view taken along a line A-A of FIG. 9A.
Figure 10B:
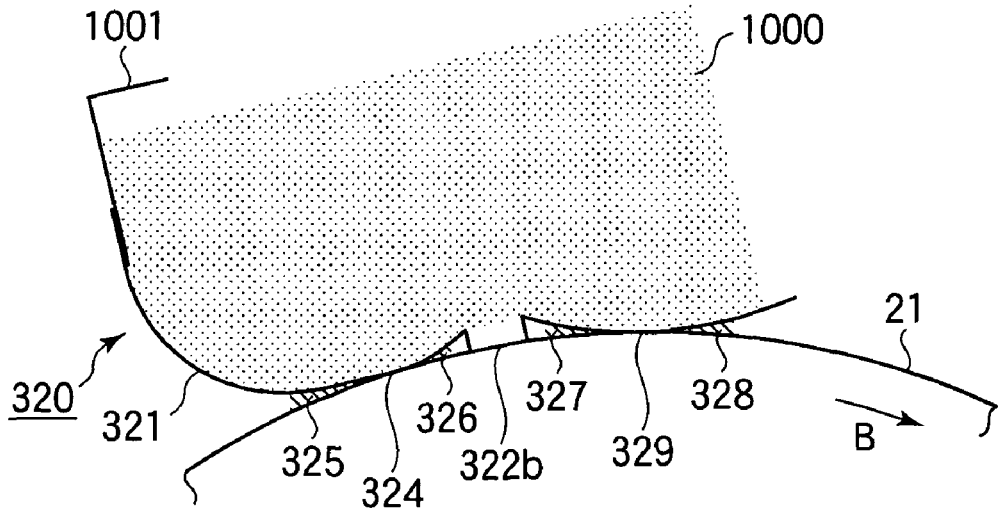
FIG. 10B is a cross-sectional view taken along a line B-B of FIG. 9A.

FIGS. 10A and 10B are partial expanded cross-sectional views of the charging film 320 in contact with the circumferential surface of the photoconductive drum 21. FIG. 10A is a cross-sectional view taken along a line A-A of FIG. 9A. FIG. 10B is a cross-sectional view taken along a line B-B of FIG. 9A.

Referring to FIG. 10A, the charging film 320 includes a first contact area 341, the three projections 322*a*-322*c*, and a second contact area 348, all being in contact with the circumferential surface of the photoconductive drum 21. Six small gap areas 342-347 are formed between the charging film 320 and the photoconductive drum 21, being located immediately upstream and immediately downstream of the first contact area 341, the three projections 322*a*-322*c*, and the second contact area 348 as well as facilitating electrical discharge between the charging film 320 and the photoconductive drum 21. The small gap area 344 between the projections 322*a* and 322*b* may be further divided into two adjacent small gap areas if the surface layer 321 contacts the surface of the photoconductive drum 21. The same is true for the small gap area 345.

Referring to FIG. 10B, the charging film 320 includes a first contact area 324, one projection 322*b*, and a second contact area 329, all being in contact with the circumferential surface of the photoconductive drum 21. Four small gap areas 325-328 are formed between the charging film 320 and the photoconductive drum 21, the small gap areas 325 and 326 being immediately upstream and downstream of the first contact area 324, and the small gap areas 327 and 328 being immediately upstream and downstream of the second contact area 329. Four small gap areas 325-328 also facilitate electrical discharge between the charging film 320 and the photoconductive drum 21.

If printing is performed repeatedly, the external additive of the residual toner particles remaining on the photoconductive drum 21 will crowd together at areas (i.e., small gap areas 325 and 342) in the vicinity of areas in which the charging film 320 is in contact with the photoconductive drum 21. The build-up of the external additive is detrimental in that the build-up exhibits a high electrical resistance between the photoconductive drum 21 and the surface layer 321 of the charging film 322, leading to the variations of electrical discharge in a longitudinal direction of the photoconductive drum 21. Also, the size of gap at the small gap areas 328 and 347 may become unstable due to the vibration of the free end portion of the charging film 322 during printing. However, stable electrical discharge may still be obtained at small gap areas other than the small gap areas 325, 342, 328, and 347.

FIG. 10A shows four small gap areas 343-346 in which stable electrical discharge is ensured. FIG. 10B shows two small gap areas 326 and 327 in which stable electrical discharge is ensured.

Referring to FIGS. 10A-10B, one or more projections 322 are arranged in a circumferential direction of the photoconductive drum 21, and are in contact with the photoconductive drum 21, creating small gaps in which electrical discharge may take place.

The external additive of the toner remaining on the photoconductive drum 21 will crowd together at the first contact areas 324 and 341. Some of the external additive may escape through the first contact areas 324 and 341 due to vibration of the charging film 22. The external additive is then carried further downstream of the first contact areas 324 and 341, reaching the projections 322.

Figure 11:
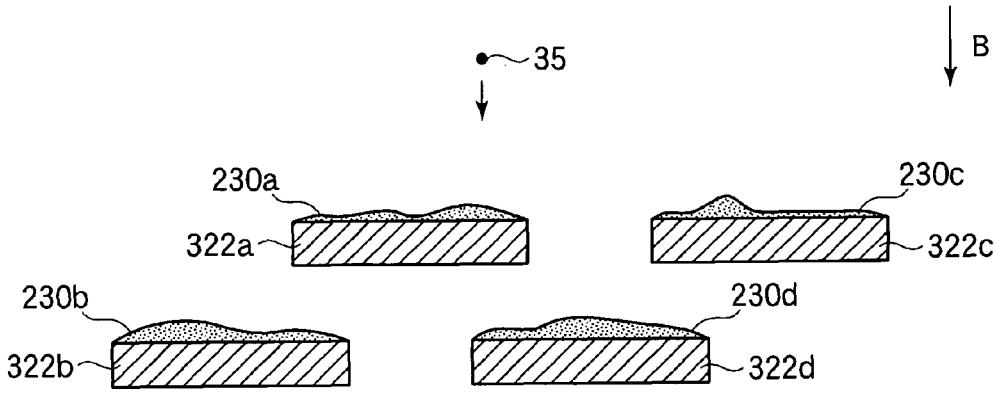
FIG. 11 illustrates the positional relationship between the build-up of the external additive and the projections as seen from above the photoconductive drum.

A description will be given of the behavior of the external additive that escapes through the first contact areas 324 and 341. FIG. 11 illustrates the positional relationship between the build-up of the external additive and the projections 322 as seen from above the photoconductive drum 21. For clarity of illustration, the charging film is omitted.

FIG. 11 illustrates four adjacent projections 322*a*-322*d* in adjacent two rows of the projections. As the photoconductive drum 21 rotates in a direction shown by arrow B, the external additive 35 moves toward the projections 322*a*-322*d*, so that the external additive 35 crowds together to form build-ups 230*a*-230*d*.

Referring to FIG. 11, the external additive 35 moves toward the projections 322*a*-322*d*, and is blocked by the projections 322*a*-322*d*, so that the build-ups 230*a*-230*c* grow due to repetitive printing operations.

Figure 12A:
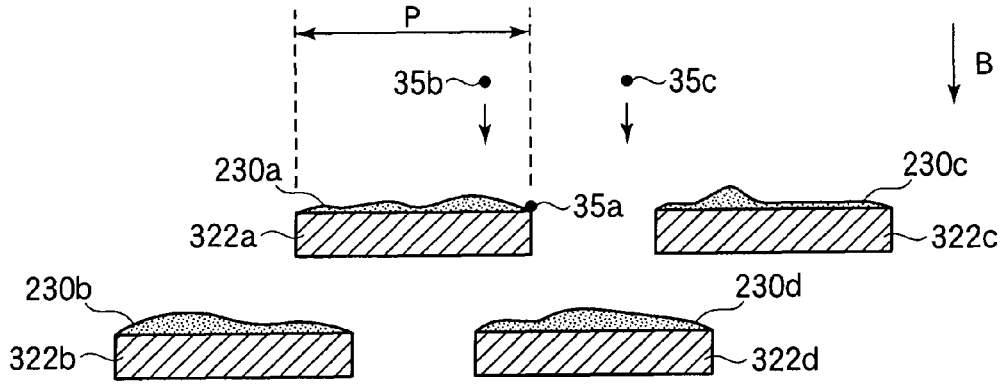
FIGS. 12A and 12B illustrate how the external additive crowds together to form build-ups of the external additive.
Figure 12B:
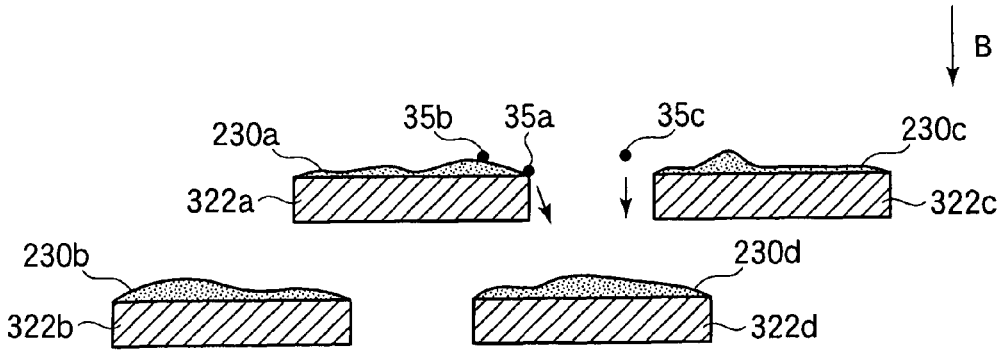

FIGS. 12A and 12B illustrate how the external additive crowds together to form the build-ups 230*a*-230*c*.

Referring to FIG. 12A, the projection 322*a* blocks the external additive 35*b*. The external additive 35*c* passes through a gap area between the projections 322*a* and 322*c*, and is blocked by the projection 322*d* to form a build-up 230*d*.

Referring to FIG. 12B, for example, as the build-up 230*a* grows, a portion of the build-up 230*a* at a longitudinal end of the projection 322*a* is pushed off the projection 322*a* and is further carried by the photoconductive drum 21 toward the projection 322*d* disposed downstream of the projection 322*a*.

As described above, if the build-ups on the projections 322*a* and 322*c* grow beyond a certain volume, then the excessive portions of the build-ups are pushed off the projections 322*a* and 322*c* and are carried to the downstream projections, so that the build-ups on the projections 322*a* and 322*c* do not exceed a certain amount. This is accomplished by the configuration (FIG. 9A) in which the projections in one of two adjacent parallel rows are staggered with respect to the projections in the other of the two adjacent parallel rows.

Even if the external additive of the toner particles escapes through the small gap areas between the charging film and the photoconductive drum, the configuration of the second embodiment prevents an excessive amount of external additive of the toner particles from accumulating in the small gap areas, while providing sufficient small gap areas for reliable uniform electrical discharge through the use of the charging film.

While the first and second embodiments have been described with respect to an image forming apparatus in the form of a printer, the present invention is not limited to this. The present invention may also be applied to, for example, facsimile machines, copying machines, and multifunction peripherals (MFPs).

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. A charging apparatus comprising a charging member that includes:

a first surface that faces a second surface of a rotatable photoconductive body; and a projection formed on the first surface to extend in a direction parallel to a longitudinal direction of the photoconductive body, said projection being in contact with the second surface, wherein the first surface includes a first area and a second area respectively upstream and downstream of said projection with respect to a rotation direction of the photoconductive body, the first and second areas being in contact with the second surface.

2. The charging apparatus according to claim 1, further comprising:

a first gap and a second gap formed between the first surface and the second surface, the first and second gaps being upstream of the projection, and being respectively upstream and downstream of the first area, and a third gap and a fourth gap formed between the first surface and the second surface, the third and fourth gaps being downstream of the projection, and being respectively upstream and downstream of the second area.

3. The charging apparatus according to claim 1, wherein said projection extends all across an image area on the photoconductive body.

4. The charging apparatus according to claim 1, wherein said projection is one of a plurality of projections aligned in a circumferential direction of the photoconductive body.

5. The charging apparatus according to claim 1, wherein said charging member is formed of a material having a Young's modulus in the range of 1 to 5 GPa.

6. The charging apparatus according to claim 1, further comprising an urging member that urges said charging member against the photoconductive body such that the first surface of said charging member is in pressure contact with the second surface.

7. The charging apparatus according to claim 1, wherein said charging member is in the form of a film.

8. A print engine that incorporates the charging apparatus according to claim 1 and the photoconductive body.

9. An image forming apparatus that incorporates the print engine according to claim 8 and a power supply that provides a voltage to the charging member.

10. A charging apparatus wherein comprising a charging member that includes:

a first surface that faces a second surface of a rotatable photoconductive body; and a plurality of rows of projections formed on the first surface, each row extending in a direction parallel to a longitudinal direction of the photoconductive body, and including a plurality of projections each also extending in said direction, each projection being in contact with the second surface; wherein the plurality of rows are arranged such that the projections in a first row of two adjacent rows are staggered with respect to the projections in a second row of the two adjacent rows, so that a projection in the first row partially overlaps two projections in the second row that are adjacent to the projection in the first row, and the first surface includes a first area and a second area respectively upstream and downstream of said projection with respect to a rotation direction of the photoconductive body, the first and second areas being in contact with the second surface.

11. The charging apparatus according to claim 10, wherein said projection extends all across an image area on the photoconductive body.

12. The charging apparatus according to claim 10, wherein said charging member is formed of a material having a Young's modulus in the range of 1 to 5 GPa.

13. The charging apparatus according to claim 10, further comprising an urging member that urges said charging member against the photoconductive body such that the first surface of said charging member is in pressure contact with the second surface.

14. The charging apparatus according to claim 10, wherein said charging member is in a form of a film.

15. A print engine that incorporates the charging apparatus according to claim 10 and the photoconductive body.

16. An image forming apparatus that incorporates the print engine according to claim 15 and a power supply that provides a voltage to the charging member.

* * * * *